US009107478B2

(12) United States Patent
Dekovic et al.

(10) Patent No.: US 9,107,478 B2
(45) Date of Patent: Aug. 18, 2015

(54) ARTICLE OF FOOTWEAR HAVING A TAPERED THROAT AND TRANSITIONAL LACING

(71) Applicant: Nike, Inc., Beaverton, OR (US)

(72) Inventors: Denis Dekovic, Portland, OR (US); John Droege, Portland, OR (US); Collin K. Eder, Portland, OR (US); Doug D. Wilken, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 275 days.

(21) Appl. No.: 13/762,598

(22) Filed: Feb. 8, 2013

(65) Prior Publication Data

US 2014/0223769 A1 Aug. 14, 2014

(51) Int. Cl.

| | |
|---|---|
| ***A43C 9/00*** | (2006.01) |
| ***A43C 1/00*** | (2006.01) |
| ***A43B 5/02*** | (2006.01) |

(52) U.S. Cl.

CPC ... *A43C 1/00* (2013.01); *A43B 5/02* (2013.01); *A43B 5/025* (2013.01); *A43C 9/00* (2013.01)

(58) Field of Classification Search

CPC ..... A43C 1/00; A43C 9/00
USPC ..... 36/50.1
See application file for complete search history.

(56) References Cited

U.S. PATENT DOCUMENTS

| | | | | |
|---|---|---|---|---|
| 742,164 | A | 10/1903 | Chapman | |
| 852,747 | A * | 5/1907 | Thun | 87/9 |
| 1,269,274 | A * | 6/1918 | Frascola | 24/713.1 |
| 1,421,291 | A | 6/1922 | Nelson | |
| 2,266,083 | A | 12/1941 | Rzepa | |
| 3,934,346 | A * | 1/1976 | Sasaki et al. | 36/138 |
| 4,081,916 | A | 4/1978 | Salisbury | |
| 4,901,451 | A | 2/1990 | Cumin | |
| 5,946,779 | A * | 9/1999 | Chen | 24/712 |
| 5,979,080 | A * | 11/1999 | Borsoi | 36/50.1 |
| 6,212,743 | B1 * | 4/2001 | Cohen | 24/713 |
| D478,414 | S | 8/2003 | Robinson, Jr. et al. | |
| 7,458,950 | B1 * | 12/2008 | Ivany | 602/28 |
| 2005/0217089 | A1 * | 10/2005 | Lin | 24/712 |

(Continued)

FOREIGN PATENT DOCUMENTS

| | | |
|---|---|---|
| CN | 202233365 U | 5/2012 |
| DE | 200 17 334 U1 | 2/2001 |

(Continued)

OTHER PUBLICATIONS

International Search Report and Written Opinion mailed Jul. 24, 2014 in PCT/US2014/014979.

*Primary Examiner* — Marie Bays
(74) *Attorney, Agent, or Firm* — Plumsea Law Group, LLC

(57) ABSTRACT

An article of footwear is provided, including an upper having an acute angular opening in a vamp region, a base of the acute angular opening being disposed in a first region of the vamp proximate to a forefoot region of the article of footwear and an end of the acute angular opening being disposed in a second region of the vamp proximate to an ankle opening region of the article of footwear; and at least one lace having a length, including a first thickness in a center region of the lace length and a second thickness at each of the two end regions of the lace, and a change in thickness of the lace between the first thickness and the second thickness varying continuously and gradually along the length lace from the center region to each of the end regions.

16 Claims, 12 Drawing Sheets

(56) References Cited

U.S. PATENT DOCUMENTS

| | | | |
|---|---|---|---|
| 2006/0185192 | A1 | 8/2006 | Biancucci |
| 2008/0276495 | A1 | 11/2008 | Jones |
| 2009/0100716 | A1 | 4/2009 | Gerber |

FOREIGN PATENT DOCUMENTS

| | | | |
|---|---|---|---|
| DE | 202 12 573 | U1 | 1/2003 |
| DE | 10 2010 043 288 | A1 | 5/2012 |
| JP | 2004-076217 | A | 3/2004 |

* cited by examiner

ARTICLE OF FOOTWEAR HAVING A TAPERED THROAT AND TRANSITIONAL LACING

TECHNICAL FIELD

This disclosure relates generally to the field of footwear.

BRIEF DESCRIPTION OF THE DRAWINGS

The accompanying drawings, which are incorporated in and constitute a part of this specification, illustrate embodiments and, together with the description, serve to explain the features, advantages, and principles of the embodiments disclosed throughout this disclosure. For illustration purposes, the following drawings may not be to scale. Moreover, like reference numerals designate corresponding parts throughout the different views. In the drawings.

DETAILED DESCRIPTION

Figure 1:
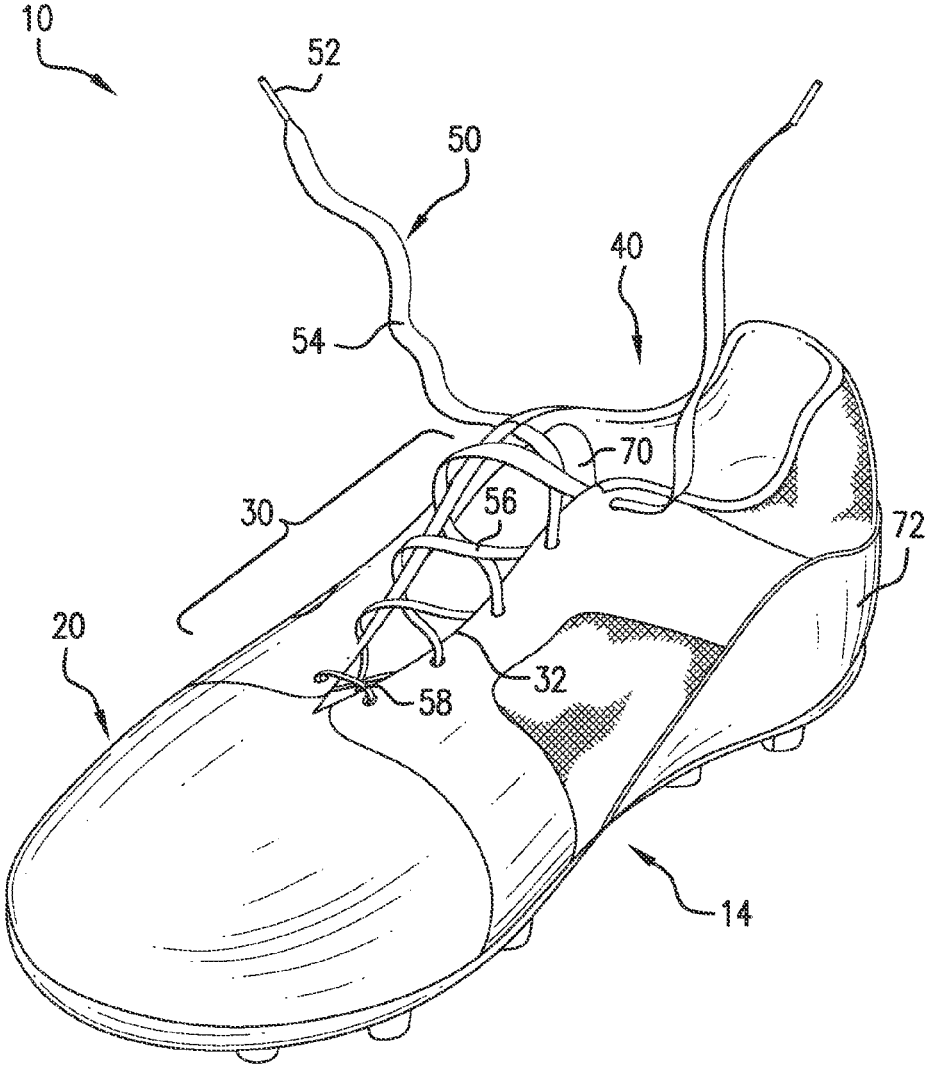
FIG. 1 shows a perspective view of an athletic shoe having a throat and lacing region in an open configuration, consistent with an embodiment of the disclosure.

The following discussion and accompanying figures disclose an article of footwear having ball control features. Consistent with an embodiment, ball control features may include a throat region having any geometric shape. For example, the throat region may taper or narrow along the length of the shoe, or have an acute angular opening. Also, for example, and consistent with an embodiment, ball control features of the throat region of the shoe may resemble a "V" shaped region. Consistent with an embodiment, ball control features may also include laces where lace thickness may change from one region to another region, or laces having a plurality of thicknesses along the lace length. For example, ball control features of lacing may include transitional lacing, where the laces are thinner near the bottom of the throat opening and gradually increase in thickness as they progress up to and beyond the top of the throat opening. Consistent with an embodiment, the gradual increase in lace thickness may vary continuously from a center region of the lace outward along the lace length to each of the two end regions of the lace. Tightening of the lacing operates to close the throat opening.

Various types of articles of footwear have been previously proposed for use in a variety of applications. Sports participants, such as soccer players, may desire an article of footwear for improving ball control in a number of situations. Conventional articles of footwear directed towards soccer, however, include limited or complicated types of ball control features. For example, some conventional articles of footwear may only include provisions for enhancing one ball control function. Some conventional articles of footwear may include complicated provisions for gripping or passing the ball, for example, which could adversely affect the weight or fit of the shoe.

Consistent with an embodiment, an article of footwear is disclosed as having a general configuration suitable for soccer. Concepts associated with the footwear may also be applied to a variety of other athletic footwear types, including, but not limited to: running shoes, baseball shoes, basketball shoes, cross-training shoes, cycling shoes, football shoes, golf shoes, tennis shoes, walking shoes, and hiking shoes and boots, for example. The concepts may also be applied to footwear types that are generally considered nonathletic, including dress shoes, loafers, sandals, and work boots. Accordingly, the concepts disclosed herein apply to a wide variety of footwear types.

In accordance with the systems and methods described throughout this disclosure, there is provided an article of footwear, comprising an upper having an acute angular opening in a vamp region, a base of the acute angular opening being disposed in a first region of the vamp proximate to a forefoot region of the article of footwear and an end of the acute angular opening being disposed in a second region of the vamp proximate to an ankle opening region of the article of footwear; and at least one lace having a length, comprising a first thickness in a center region of the lace length and a second thickness at each of the two end regions of the lace, and a change in thickness of the lace between the first thickness and the second thickness varying continuously and gradually along the length lace from the center region to each of the end regions.

In accordance with the systems and methods described throughout this disclosure, there is also provided an article of footwear, comprising an upper having an acute angular opening in a vamp region, a base of the acute angular opening being disposed in a first region of the vamp proximate to a forefoot region of the article of footwear and an end of the acute angular opening being disposed in a second region of the vamp proximate to an ankle opening region of the article of footwear; at least two pairs of lace apertures proximate to the acute angular opening; and at least one lace having a length, the lace comprising a first thickness in a first region of a first of the at least two pairs of lace apertures, and a second thickness in a second region of a second of the at least two pairs of lace apertures, wherein the first of the at least two pairs of lace apertures is closer to the first region of the vamp proximate to the forefoot region of the article of footwear, and the second of the at least two pairs of lace apertures is closer to the second region of the vamp proximate to the forefoot region of the article of footwear.

Additional features and advantages will be set forth in part in the description that follows, being apparent from the description or learned by practice of embodiments. Both the foregoing description and the following description are exemplary and explanatory, and are intended to provide further explanation of the embodiments as claimed.

An article of footwear generally includes two primary elements: an upper and a sole structure. The upper may be formed from a plurality of material elements (e.g., one or more layers of a textile, a natural fabric, a synthetic fabric, a knit, a woven material, a nonwoven material, a mesh, a leather, a synthetic leather, a polymer, a rubber, and a foam, etc.) stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust fit of the footwear, as well as permitting entry and removal of the foot from the void within the upper. In addition, the upper may include a tongue that extends under the lacing system to enhance adjustability and comfort of the footwear, and the upper may incorporate a heel counter.

A sole structure is secured to a lower portion of the upper to be positioned between the foot and the ground. In athletic footwear, for example, the sole structure includes a midsole and an outsole. The midsole may be formed from a polymer foam material that attenuates ground reaction forces (i.e., provides cushioning) during walking, running, and other ambulatory activities. The midsole may also include cushions, such as fluid-filled chambers, plates, moderators, or other elements that further attenuate forces, enhance stability, or influence the motions of the foot, for example. The outsole forms a ground-contacting element of the footwear and is usually fashioned from a durable and wear-resistant rubber material that includes texturing to impart traction. The sole structure may also include a sockliner positioned within the upper and proximal to a lower surface of the foot to enhance footwear comfort.

Figure 2:
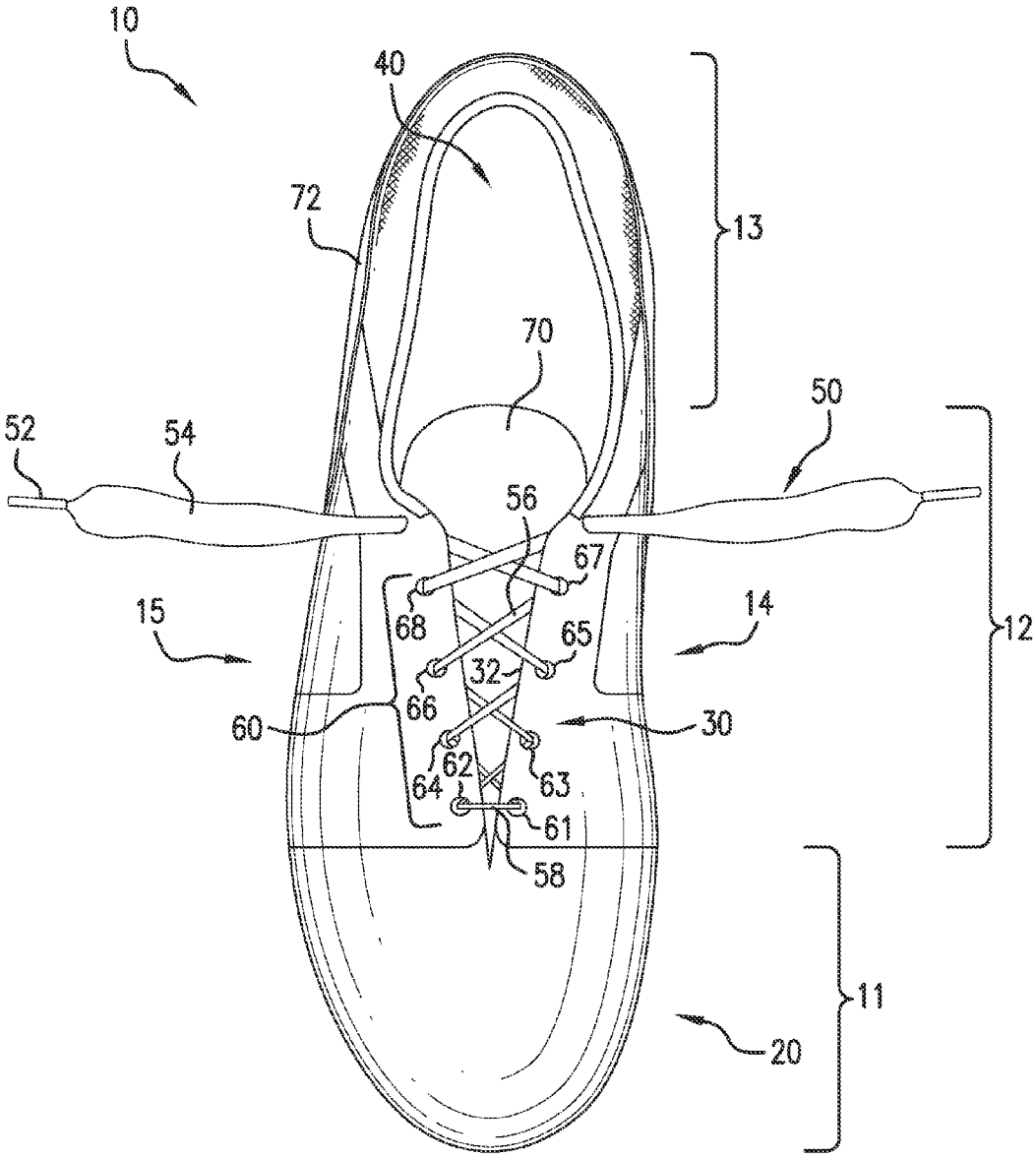
FIG. 2 shows an elevated view of a top portion of an athletic shoe having a throat and lacing region in an open configuration, consistent with an embodiment of the disclosure.

Consistent with an embodiment, an article of footwear 10, throughout this disclosure referred to simply as footwear 10, is depicted in FIGS. 1-4 as including a vamp or upper 20. For reference purposes, footwear 10 may be divided into three general regions: a forefoot region 11, a midfoot region 12, and a heel region 13. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot, and heel region 13 corresponds with rear portions of the foot, including the calcaneus bone. Lateral side 14 and medial side 15 extend through each of forefoot region 11, midfoot region 12, and heel region 13 (as seen in FIG. 2) and correspond with opposite sides of footwear 10 that are separated by a throat and lacing region 30, which extends along a length of footwear 10.

While region 30 is depicted in FIGS. 1-4 as including a V-throat, where the shape of the throat and eyelet region may resemble a "V," the throat may be any geometric shape, and may taper or narrow along a length of footwear 10, and may have an acute angular opening. Moreover, while region 30 is depicted in FIGS. 1-4 as including transitional lacing, where the laces are thinner near the bottom of the throat opening and gradually increase in thickness as they progress up to and beyond the top of the throat opening, region 30 may also include laces where lace thickness changes from one region to another region, or laces having a plurality of thicknesses along the lace length. Consistent with an embodiment, a gradual increase in lace thickness may vary continuously from a center region of the lace outward along the lace length to each of the two end regions of the lace.

Forefoot region 11, midfoot region 12, heel region 13, lateral side 14, and medial side 15 are not intended to demarcate precise areas of footwear 10. Rather, they are intended to represent general areas of footwear 10 to aid in this description. In addition to footwear 10, forefoot region 11, midfoot region 12, heel region 13, lateral side 14, and medial side 15 may also be applied to upper 20, and individual elements thereof.

Portions of upper 20 may be stitched or bonded together to form a void within footwear 10 for receiving and securing a foot through ankle opening 40. The void is shaped to accommodate the foot and extends along the lateral side of the foot, along the medial side of the foot, over the foot, around the heel, and under the foot. Access to the void is provided by an ankle opening 40 located in at least heel region 13. Throat and lacing region 30 may be used to improve access to the void, and to secure footwear 10 to the foot.

Lace 50 may extend through various lace apertures 60 and permits the wearer to modify dimensions of upper 20 to accommodate the proportions of the foot. More particularly, lace 50 may permit the wearer to tighten upper 20 around the foot, and lace 50 may permit the wearer to loosen upper 20 to facilitate entry and removal of the foot from the void (i.e., through ankle opening 40). As an alternative to lace apertures 60, upper 20 may include other lace-receiving elements, such as loops, eyelets, and D-rings. Thus, the shape of lacing apertures 60 may vary. Consistent with an embodiment, lacing apertures 60 may be circular, or may be any other suitable shape for allowing laces to pass through and close the throat and lacing region 30.

In addition, upper 20 may include a tongue 70 that extends between ankle opening 40 and lace 50 to enhance the comfort and performance of footwear 10. In some configurations, upper 20 may incorporate a heel counter, such as heel counter 72, which limits heel movement, or a wear-resistant toe guard. Upper 20 may include a plurality of lace apertures 60, comprising first lace aperture 61, second lace aperture 62, third lace aperture 63, fourth lace aperture 64, fifth lace aperture 65, sixth lace aperture 66, seventh lace aperture 67, and eighth lace aperture 68. Lace apertures 60 may include additional apertures, and may be evenly spaced. Lace apertures 60 may extend from ankle opening 40 to forefoot region 11. Consistent with an embodiment, lace 50 may be interwoven though apertures 60 in any suitable configuration, which will be explained in greater detail later.

Upper 20 is depicted as having a configuration incorporating a plurality of material elements (e.g., textiles, polymer sheets, foam layers, leather, and synthetic leather). The material elements are stitched or adhesively bonded together to form an interior void for securely and comfortably receiving a foot. The material elements may be selected and located with respect to upper 20 to selectively impart properties of durability, air-permeability, wear-resistance, flexibility, and comfort, for example.

Consistent with an embodiment, throat and lacing region 30 may provide a fastening system to secure footwear 10 to the foot. Throat and lacing region 30 may modify the dimensions of the interior void, thereby securing the foot within the interior void and facilitating entry and removal of the foot from the interior void. In addition, throat and lacing region 30 may be used to improve ball control with footwear 10 during athletic or recreational use. Also consistent with an embodiment, throat and lacing region 30 may comprise an acute angular opening in upper 20, having a base of the acute angular opening disposed in a region of upper 20 proximate to forefoot region 11 of footwear 10, and having an end of the acute angular opening disposed in another region of upper 20 proximate to an ankle opening region 40 of footwear 10. The acute angular opening of throat and lacing region 30 may resemble a "V" shape, and may vary, for example, from approximately 1 degree to approximately 50 degrees in an open configuration.

Figure 3:
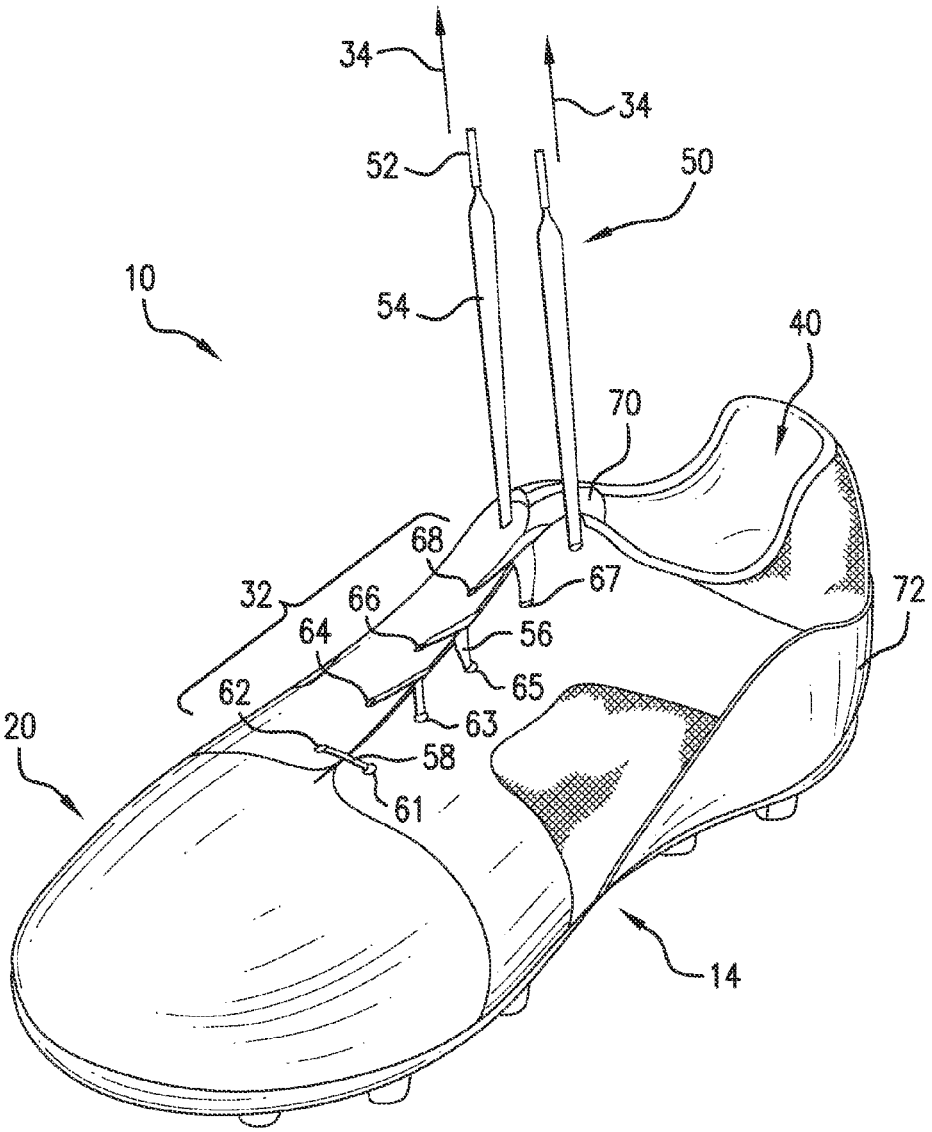
FIG. 3 shows a perspective view of an athletic shoe having a throat and lacing region in a closed configuration, consistent with an embodiment of the disclosure.
Figure 4:
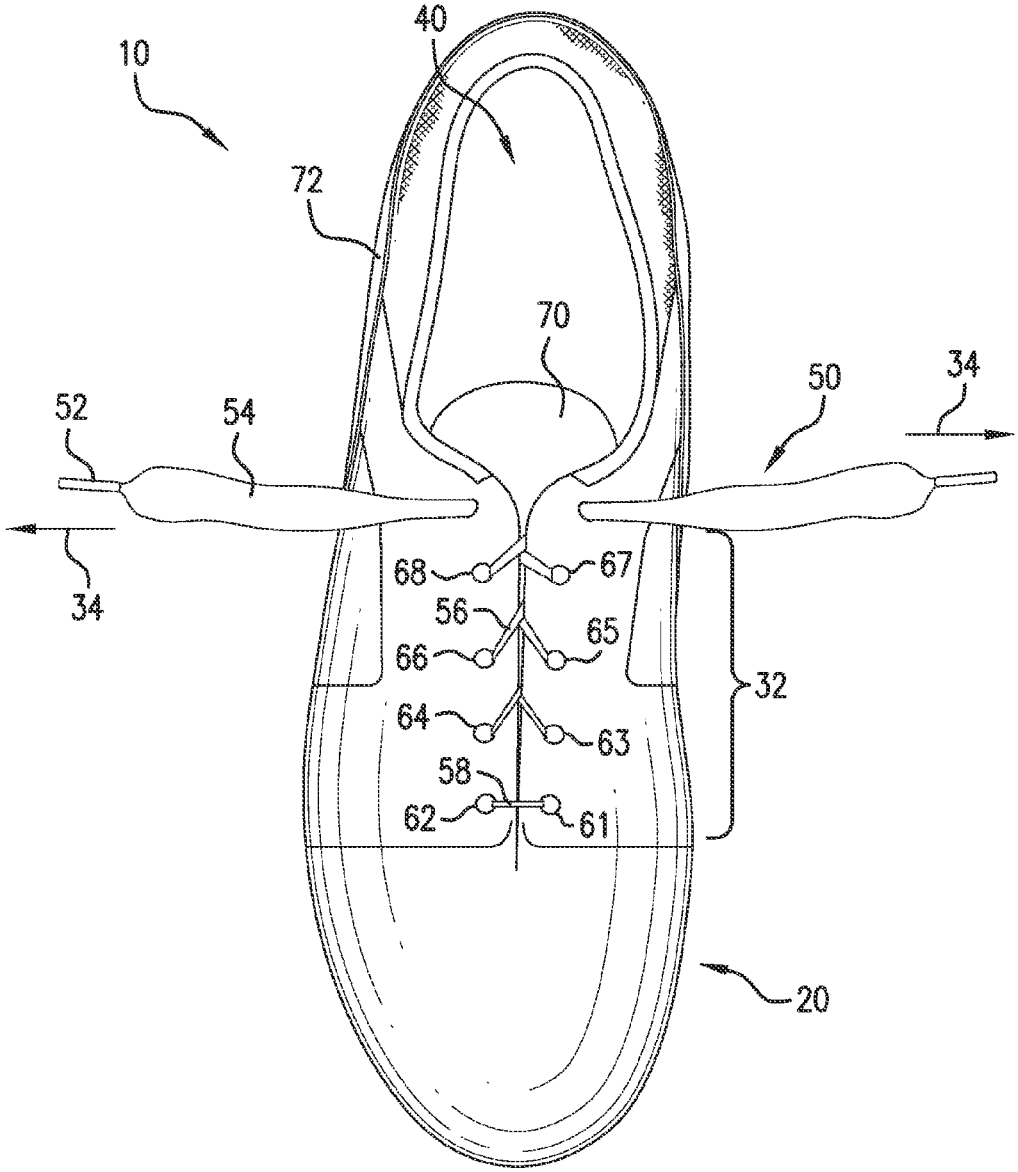
FIG. 4 shows an elevated view of a top portion of an athletic shoe having a throat and lacing region in a closed configuration, consistent with an embodiment of the disclosure.

Consistent with an embodiment, and referring to FIGS. 1-4, throat and lacing region 30 may be in an open configuration (as shown in FIGS. 1 and 2), and may be in a closed or tied configuration (as shown in FIGS. 3 and 4). When in a closed or tied configuration as shown in FIGS. 3 and 4, region 30 will be referred to as "closed throat and lacing region 32." Closed throat and lacing region 32 may facilitate improved ball control by providing a simple, lightweight, and relatively unobstructed surface for contact with an athletic ball. Advantages of closed throat and lacing region 32 may also be improved with use of lace 50.

Figure 5:
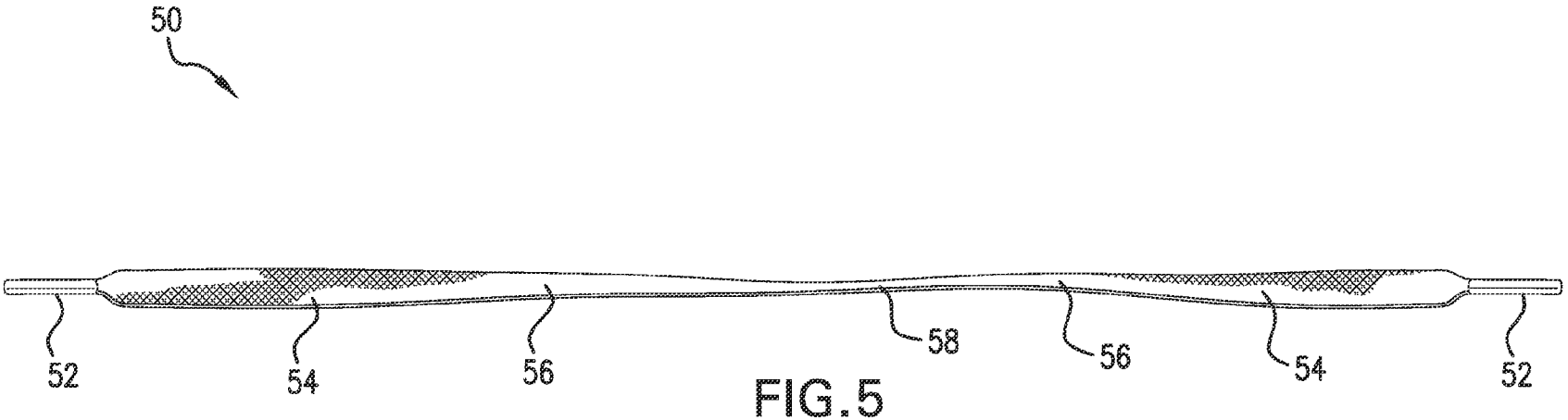
FIG. 5 shows a perspective view of a variable thickness transitional lace in an extended configuration, consistent with an embodiment of the disclosure.

Referring to FIG. 5, and consistent with an embodiment, lace 50 is shown in an untied and extended configuration. As shown in FIG. 5, lace 50 may include transitional lacing, where lace 50 may be thinner in a middle region and gradually increase in thickness extending gradually outward to the end regions of lace 50. Consistent with an embodiment, this gradual increase in lace thickness may vary continuously from a center region of the lace outward along the lace length to each of the two end regions of the lace. Also consistent with an embodiment, lace 50 may include lacing where thickness of the lace changes from one region to another along the lace length, or where thickness of the lace changes generally in some regions or parts.

Consistent with an embodiment, and as shown in FIG. 5, lace 50 may comprise end caps 52, first regions 54, second regions 56, and third region 58. First regions 54, second regions 56, and third region 58 are used herein as general indicators of approximate portions of lace 50, and are not intended to refer to discrete portions of the lace. Lace end caps 52 may be used to prevent fraying or otherwise splitting of lacing materials, and may be used to facilitate entry of lace 50 into one or more of lace apertures 60 with minimal frustration for the wearer. Lace 50 may comprise any suitable lacing material, including textile, fabric, plastic, metal, cord, or wire, and may be formed in any suitable configuration including braiding, woven, solid, composite, wound, or twisted. Also consistent with an embodiment, lace 50, while depicted in FIG. 5 as having a flattened configuration, may also have a rounded configuration, or any other desired configuration or cross-sectional shape.

Still referring to FIG. 5, and consistent with an embodiment, lace 50 may comprise a continuous varying diameter or thickness along its length. Thus, lace 50 may be referred to as transitional lacing. For example, third region 58 may be the thinnest portion of lace 50 and be located proximate to the center of the lace when depicted in an extended configuration as shown in FIG. 5. First regions 54 may be the thickest portion of lace 50 and be located proximate to the end portions of the lace when depicted in an extended configuration as shown in FIG. 5. Second regions 56 may have an intermediate thickness and be located in between third region 58 and first regions 54. Consistent with an embodiment, the thickness of lace 50 may vary continually when taken from third region 58 moving outward in each direction toward end caps 52. This continuous thickness variation in lace 50 provides a smooth and uninterrupted change in thickness from thin to thick as measured along the lace length in each direction starting at third region 58. Lace 50 may thus be described as having a first thickness in a center region of the lace length (e.g., third region 58) and a second thickness at each of the two end regions of the lace (e.g., first regions 54), wherein a change in thickness between the first thickness and the second thickness varies continuously and gradually along the lace length from the center region to each of the end regions.

Lace 50 may comprise any suitable length for securing one or more pairs of apertures 60, and has a first thickness in a center region of the lace length and a second thickness at each of the two end regions of the lace. Lace 50 may also comprise a change in thickness between the first thickness and the second thickness that varies continuously and gradually along the length lace from third region 58 to each of the end regions 54. Consistent with an embodiment, lace 50 may comprise a transition in thickness from a center portion to each of its two end portions that varies as a function of the lace length. The thickness transition may thus comprise a full length of lace 50, as measured from third region 58 to each of the two end regions 54.

Consistent with an embodiment, when lace 50 is inserted into lace apertures 60, as shown in FIGS. 1-4, third region 58 may be situated proximate to a first set of lace apertures (for example, lace aperture 61 and lace aperture 62) and extend toward a second set of lace apertures (for example, lace aperture 63 and lace aperture 64). Similarly, second regions 56 may be situated proximate to a third set of lace apertures (for example, lace aperture 65 and lace aperture 66), and first regions 54 may be situated proximate to a fourth set of lace apertures (for example, lace aperture 67 and lace aperture 68). Consistent with an embodiment, lace 50 may have greater material strength in first regions 54 due to the larger lace diameter in these regions. This strength may be beneficial on footwear 10 in the region of the fourth set of lace apertures (for example, lace aperture 67 and lace aperture 68) and any additional apertures, which may experience the greatest stress and strain during athletic use. Similarly, lace 50 may have a lower material strength in third region 58 due to the thinner lace diameter in this region. This may be beneficial on footwear 10 in the region of the first set of lace apertures (for example, lace aperture 61 and lace aperture 62), which may experience the least stress and strain during athletic use.

Pulling on lace 50, as shown in FIGS. 3 and 4 may operate to close the throat portion of throat and lacing region 30 (as shown in FIGS. 1 and 2), converting it to the closed throat and lacing region 32 (as shown in FIGS. 3 and 4). Closed throat and lacing region 32 may secure the foot in footwear 10, and provide ball control surfaces and features to be discussed later. The acute angular opening of closed throat and lacing region 32 may vary, for example, from approximately zero degrees to approximately 10 degrees in a laced and closed configuration.

Consistent with an embodiment, the throat region of throat and lacing region 30 may be laced and closed in a variety of configurations. In a first exemplary configuration, shown in FIGS. 6 and 7, throat and lacing region 30 may be laced by lace 50 in an over-over crisscross pattern as shown by arrows 600 in FIG. 6. That is, end caps 52 may be inserted through the top of first lace aperture 61 and second lace aperture 62, and lace 50 may be pulled through to center lace 50 across the distance spanning first lace aperture 61 and second lace aperture 62. Thus, the thinnest portion of lace 50, third region 58, may be situated nearest the bottom of the throat portion of throat and lacing region 30 across a distance spanning a space between first lace aperture 61 and second lace aperture 62.

Figure 6:
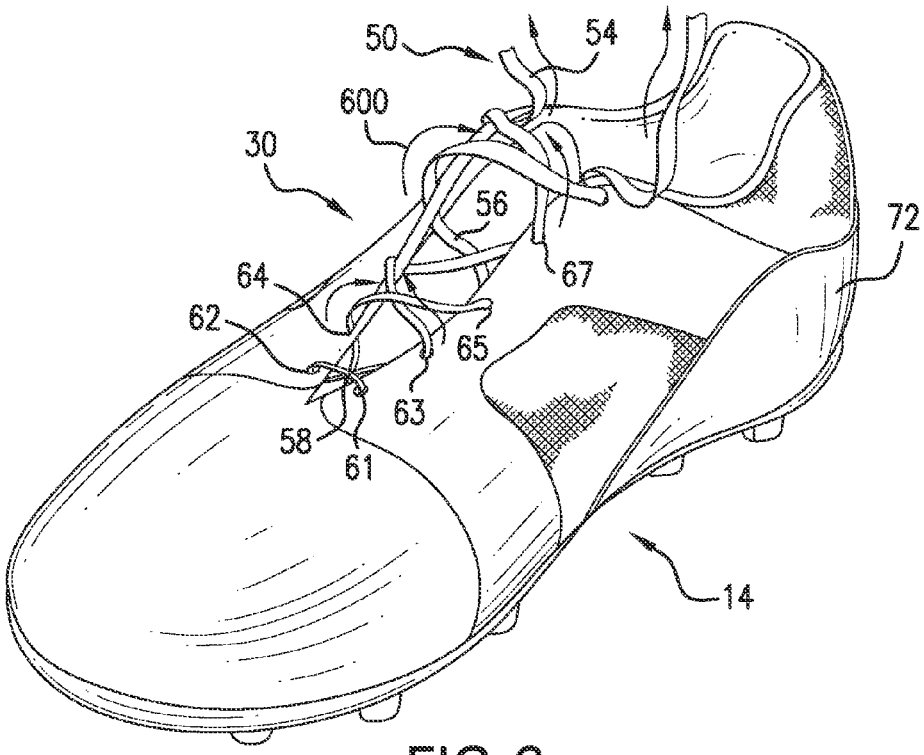
FIG. 6 shows a perspective view of an athletic shoe having a throat and lacing region threaded in a first exemplary open configuration, consistent with an embodiment of the disclosure.

Still referring to FIG. 6, end caps 52 may then be crossed underneath the throat portion of throat and lacing region 30 (and above tongue 70), and inserted through the bottom of third lace aperture 63 and fourth lace aperture 64, respectively. Lace 50 may then be crisscrossed above third lace aperture 63 and fourth lace aperture 64, and end caps 52 may be inserted through the top of fifth lace aperture 65 and sixth lace aperture 66, as shown in FIG. 6. Thus, the intermediate portion of lace 50, around second regions 56, may be situated nearest to the second set of lace apertures (for example, lace aperture 63 and lace aperture 64) and third set of lace apertures (for example, lace aperture 65 and lace aperture 66), respectively.

Still referring to FIG. 6, end caps 52 may then be crossed again underneath the throat portion of throat and lacing region 30 (and above tongue 70), and inserted through the bottom of seventh lace aperture 67 and eighth lace aperture 68, respectively. Lace 50 may then be crisscrossed above seventh lace aperture 67 and eighth lace aperture 68, and end caps 52 may be inserted through an optional final set of lacing apertures nearest ankle opening 40, as shown in FIG. 6. Thus, the thickest portion of lace 50, around first regions 54, may be situated nearest to the fourth set of lace apertures (for example, lace aperture 67 and lace aperture 68), and extend beyond them, respectively.

Figure 7:
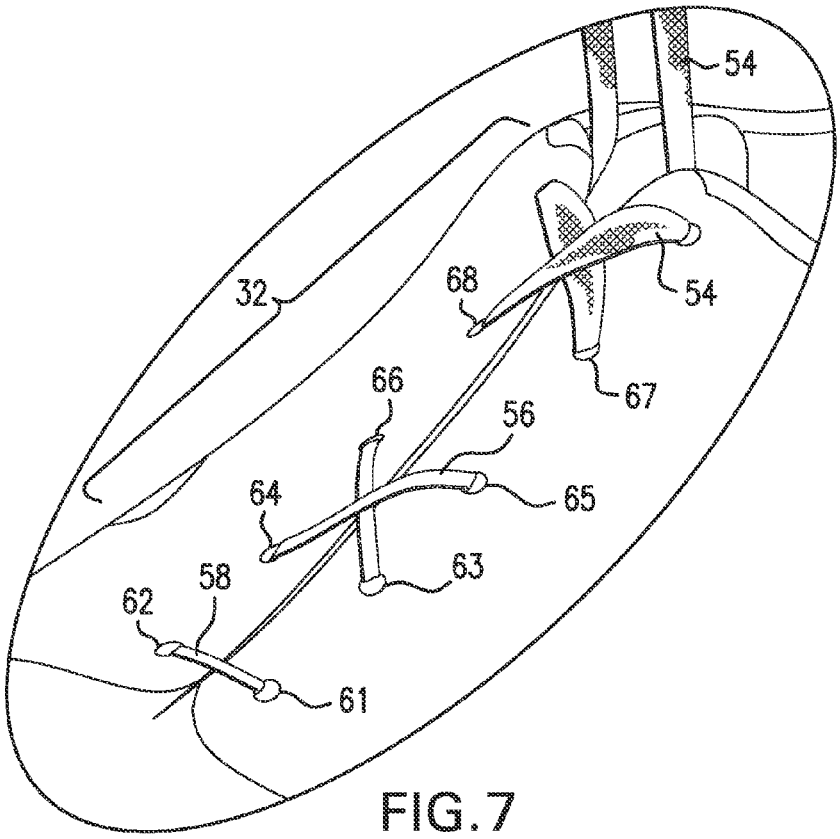
FIG. 7 shows a perspective view of a portion of the athletic shoe of FIG. 6, with the lacing threaded in a first exemplary closed configuration, consistent with an embodiment of the disclosure.

Consistent with an embodiment, and referring to FIG. 7, when lace 50 is tightened or pulled after lacing as shown in FIG. 6, lace 50 operates to close the throat region of throat and lacing region 30 to form closed throat and lacing region 32. As shown in FIG. 7, the continuously variable thickness of lace 50 is shown from regions where lower strength may be desired (for example, proximate to lace aperture 61 and lace aperture 62), to regions where more strength may be desired (for example, proximate to lace aperture 63, lace aperture 64, lace aperture 65, and lace aperture 66), to regions where even more strength may be desired (for example, proximate to lace aperture 67 and lace aperture 68). Consistent with an embodiment, lace 50 gets thicker as it passes through each set of lacing apertures. Moreover, if lace 50 has a substantially flat configuration, as shown in the example of FIG. 7, lace 50 may lay flat across the surface of upper 20 when pulled and tied on closed throat and lacing region 32.

Figure 8:
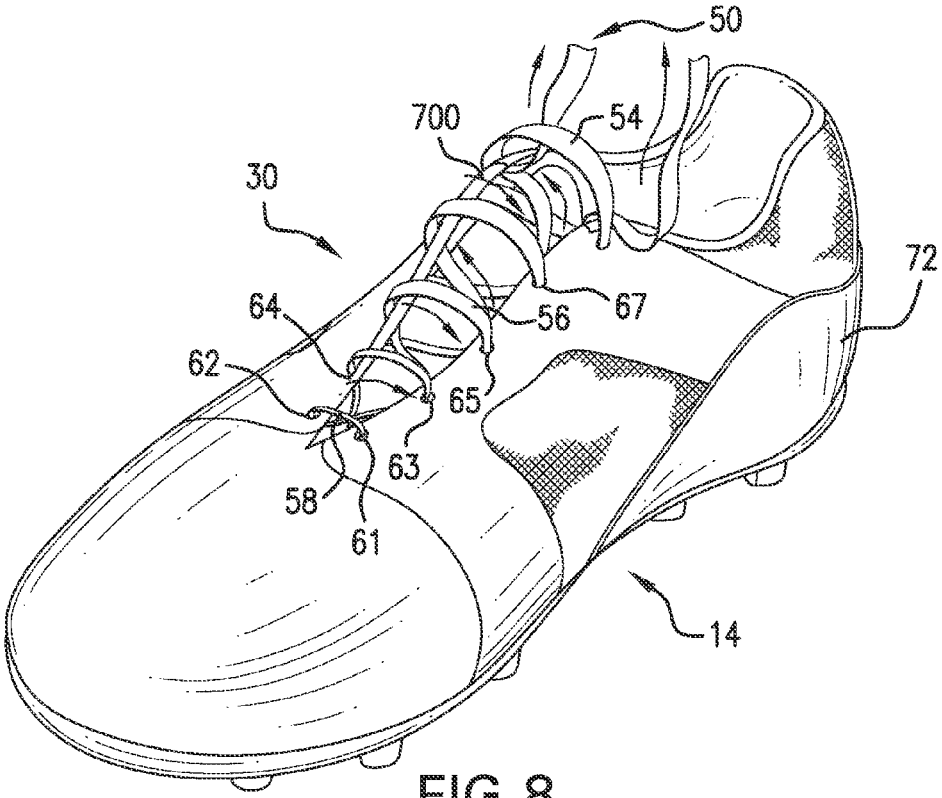
FIG. 8 shows a perspective view of an athletic shoe having a throat and lacing region threaded in a second exemplary open configuration, consistent with an embodiment of the disclosure.
Figure 9:
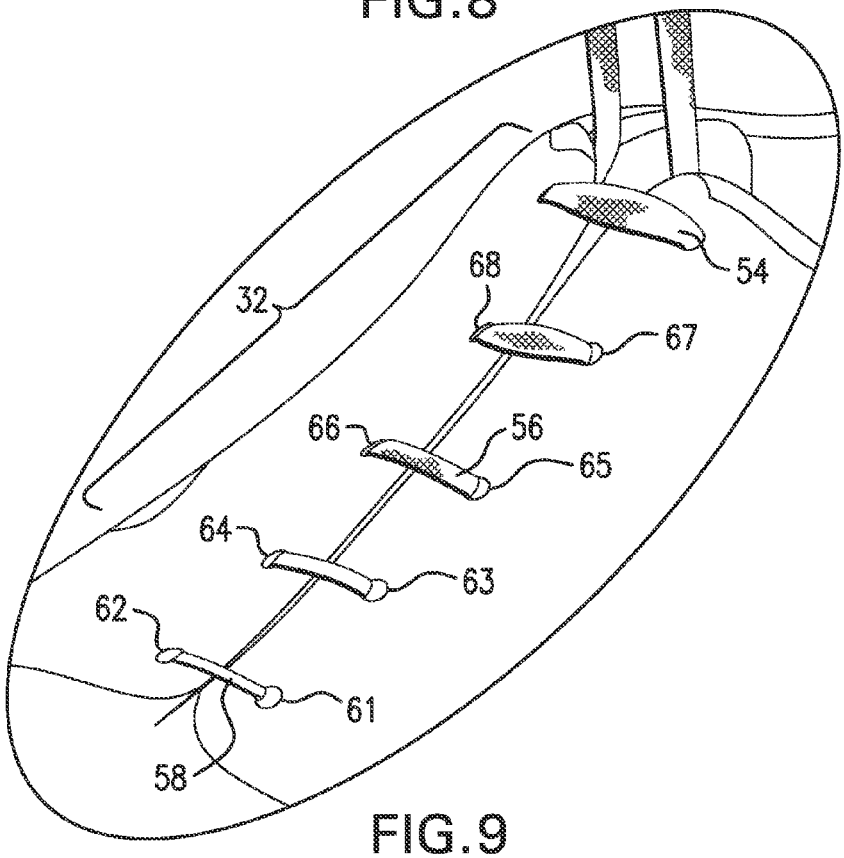
FIG. 9 shows a perspective view of a portion of the athletic shoe of FIG. 8, with the lacing threaded in a second exemplary closed configuration, consistent with an embodiment of the disclosure.

Consistent with an embodiment, the throat region of throat and lacing region 30 may be laced and closed in a second exemplary configuration, shown in FIGS. 8 and 9. Referring to FIGS. 8 and 9, throat and lacing region 30 may be laced by lace 50 in straight-laced pattern as shown by arrows 700 in FIG. 8. That is, end caps 52 may be inserted through the top of lace aperture 61 and lace aperture 62, respectively, and lace 50 may be pulled through to center lace 50 across the distance spanning lace aperture 61 and lace aperture 62. Thus, the thinnest portion of lace 50, third region 58, may be situated nearest the bottom of the throat portion of throat and lacing region 30 across the first set of lacing apertures (for example, lace aperture 61 and lace aperture 62).

Still referring to FIG. 8, one of end caps 52 may then be crossed underneath the throat portion of throat and lacing region 30 (and above tongue 70), and inserted through the bottom of either of lace aperture 67 or lace aperture 68, or either of the optional uppermost lacing apertures. The other one of end caps 52 may be crossed underneath the throat portion of throat and lacing region 30 (and above tongue 70), and inserted through the bottom of lace aperture 64. The portion of lace 50 may then be pulled through lace aperture 64, moved parallel to the portion of lace 50 bridging lace aperture 61 and lace aperture 62, and one of end caps 52 may be inserted through the top of lace aperture 63, as shown in FIG. 8. Thus, part of intermediate portion of lace 50, around second regions 56, may be situated nearest to the second set of lace apertures (for example, lace aperture 63 and lace aperture 64), respectively.

Still referring to FIG. 8, one of end caps 52 may then be crossed again underneath the throat portion of throat and lacing region 30 (and above tongue 70), and inserted through the bottom of lace aperture 66. The portion of lace 50 may then be pulled through aperture 66, moved parallel to the portion of lace 50 bridging lace aperture 63 and lace aperture 64, and the one of end caps 52 may be inserted through the top of lace aperture 65, as shown in FIG. 8. Thus, another part of intermediate portion of lace 50, around second regions 56, may be situated nearest to the third set of lace apertures (for example, lace aperture 65 and lace aperture 66), respectively.

Still referring to FIG. 8, one of end caps 52 may then be crossed again underneath the throat portion of throat and lacing region 30 (and above tongue 70), and inserted through the bottom of lace aperture 68. The portion of lace 50 may then be pulled through aperture 68, moved parallel to the portion of lace 50 bridging lace aperture 65 and lace aperture 66, and the one of end caps 52 may be inserted through the top of lace aperture 67, as shown in FIG. 8. Thus, the thickest portion of lace 50, around first regions 54, may be situated nearest to the fourth set of lace apertures (for example, lace aperture 67 and lace aperture 68), and extend beyond them, respectively.

Consistent with an embodiment, and referring to FIG. 9, when lace 50 is tightened or pulled after straight lacing as shown in FIG. 8, lace 50 operates to close the throat region of throat and lacing region 30 to form closed throat and lacing region 32. As shown in FIG. 9, the continuously variable thickness of lace 50 is shown from regions where lower strength may be desired (for example, proximate to lace aperture 61 and lace aperture 62), to regions where more strength may be desired (for example, proximate to lace aperture 63, lace aperture 64, lace aperture 65, and lace aperture 66), to regions where even more strength may be desired (for example, proximate to lace aperture 67 and lace aperture 68). Consistent with an embodiment, lace 50 gets thicker as it passes through each set of lacing apertures. Moreover, if lace 50 has a substantially flat configuration, as shown in the example of FIG. 9, lace 50 may lay flat across the surface of upper 20 when pulled and tied on closed throat and lacing region 32.

Figure 10:
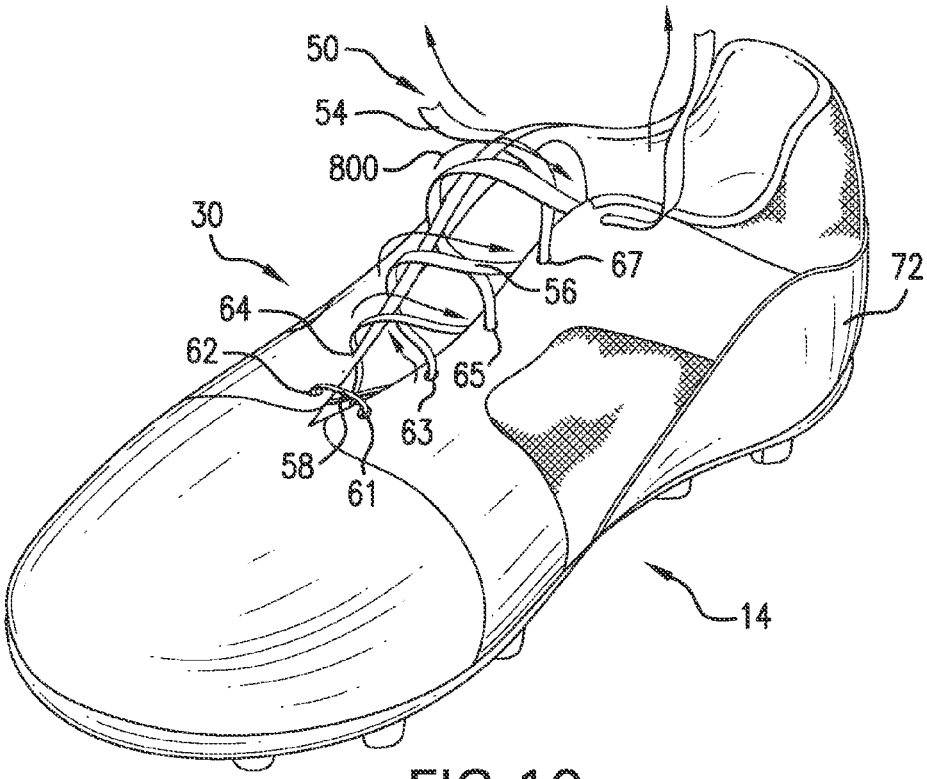
FIG. 10 shows a perspective view of an athletic shoe having a throat and lacing region threaded in a third exemplary open configuration, consistent with an embodiment of the disclosure.
Figure 11:
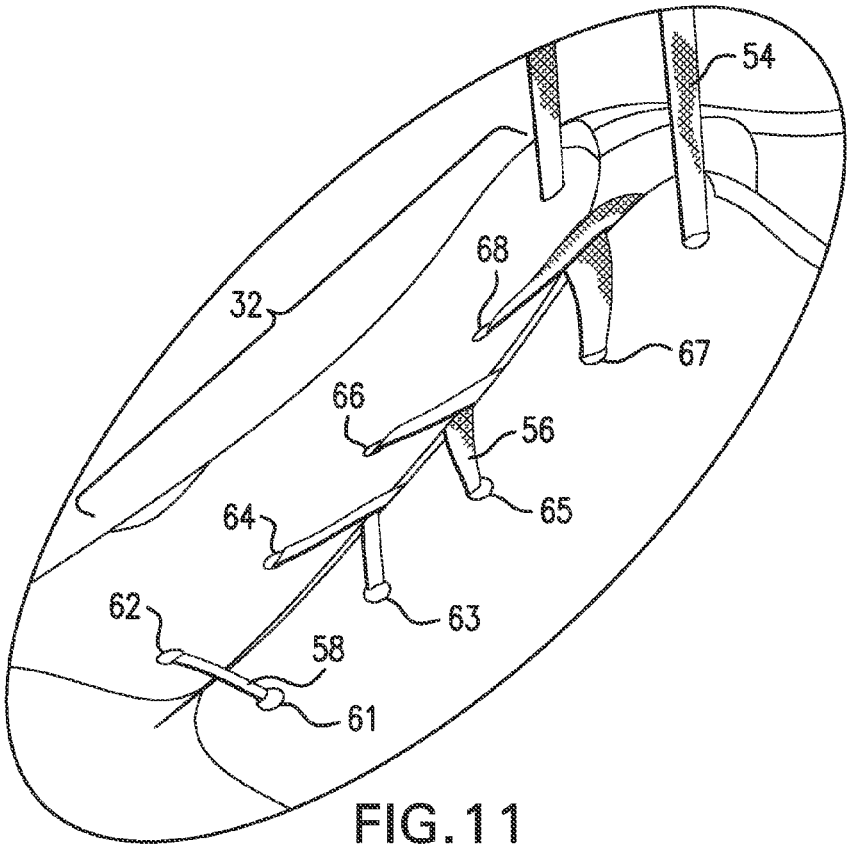
FIG. 11 shows a perspective view of a portion of the athletic shoe of FIG. 10, with the lacing threaded in a third exemplary closed configuration, consistent with an embodiment of the disclosure.

Consistent with an embodiment, the throat region of throat and lacing region 30 may be laced and closed in a third exemplary configuration, shown in FIGS. 10 and 11. Referring to FIGS. 10 and 11, throat and lacing region 30 may be laced by lace 50 in an over-under crisscross pattern as shown by arrows 800 in FIG. 10. That is, end caps 52 may be inserted through the top of first lace aperture 61 and second lace aperture 62, and lace 50 may be pulled through to center lace 50 across the distance spanning first lace aperture 61 and second lace aperture 62. Thus, the thinnest portion of lace 50, third region 58, may be situated nearest the bottom of the throat portion of throat and lacing region 30 across a distance spanning a space between first lace aperture 61 and second lace aperture 62.

Still referring to FIG. 10, end caps 52 may then be crossed underneath the throat portion of throat and lacing region 30 (and above tongue 70), and inserted through the bottom of third lace aperture 63 and fourth lace aperture 64, respectively. Lace 50 may then be crisscrossed below third lace aperture 63 and fourth lace aperture 64, and end caps 52 may be inserted through the bottom of fifth lace aperture 65 and sixth lace aperture 66, as shown in FIG. 10. Thus, the intermediate portion of lace 50, around second regions 56, may be situated nearest to the second set of lace apertures (for example, lace aperture 63 and lace aperture 64) and second and third set of lace apertures (for example, lace aperture 65 and lace aperture 66), respectively.

Still referring to FIG. 10, end caps 52 may then be crossed again underneath the throat portion of throat and lacing region 30 (and above tongue 70), and inserted through the bottom of seventh lace aperture 67 and eighth lace aperture 68, respectively. Lace 50 may then be crisscrossed below seventh lace aperture 67 and eighth lace aperture 68, and end caps 52 may be inserted through the bottom of an optional final set of lacing apertures nearest ankle opening 40, as shown in FIG. 10. Thus, the thickest portion of lace 50, around first regions 54, may be situated nearest to the fourth set of lace apertures (for example, lace aperture 67 and lace aperture 68), and extend beyond them, respectively.

Consistent with an embodiment, and referring to FIG. 11, when lace 50 is tightened or pulled after lacing as shown in FIG. 10, lace 50 operates to close the throat region of throat and lacing region 30 to form closed throat and lacing region 32. As shown in FIG. 11, the continuously variable thickness of lace 50 is shown from regions where lower strength may be desired (for example, proximate to first lace aperture 61 and second lace aperture 62), to regions where more strength may be desired (for example, proximate to third lace aperture 63, fourth lace aperture 64, fifth lace aperture 65, and sixth lace aperture 66), to regions where even more strength may be desired (for example, proximate to seventh lace aperture 67 and eighth lace aperture 68). Consistent with an embodiment, lace 50 gets thicker as it passes through each set of lacing apertures. Moreover, if lace 50 has a substantially flat configuration, as shown in the example of FIG. 11, lace 50 may lay flat across the surface of upper 20 when pulled to form closed throat and lacing region 32.

Figure 12:
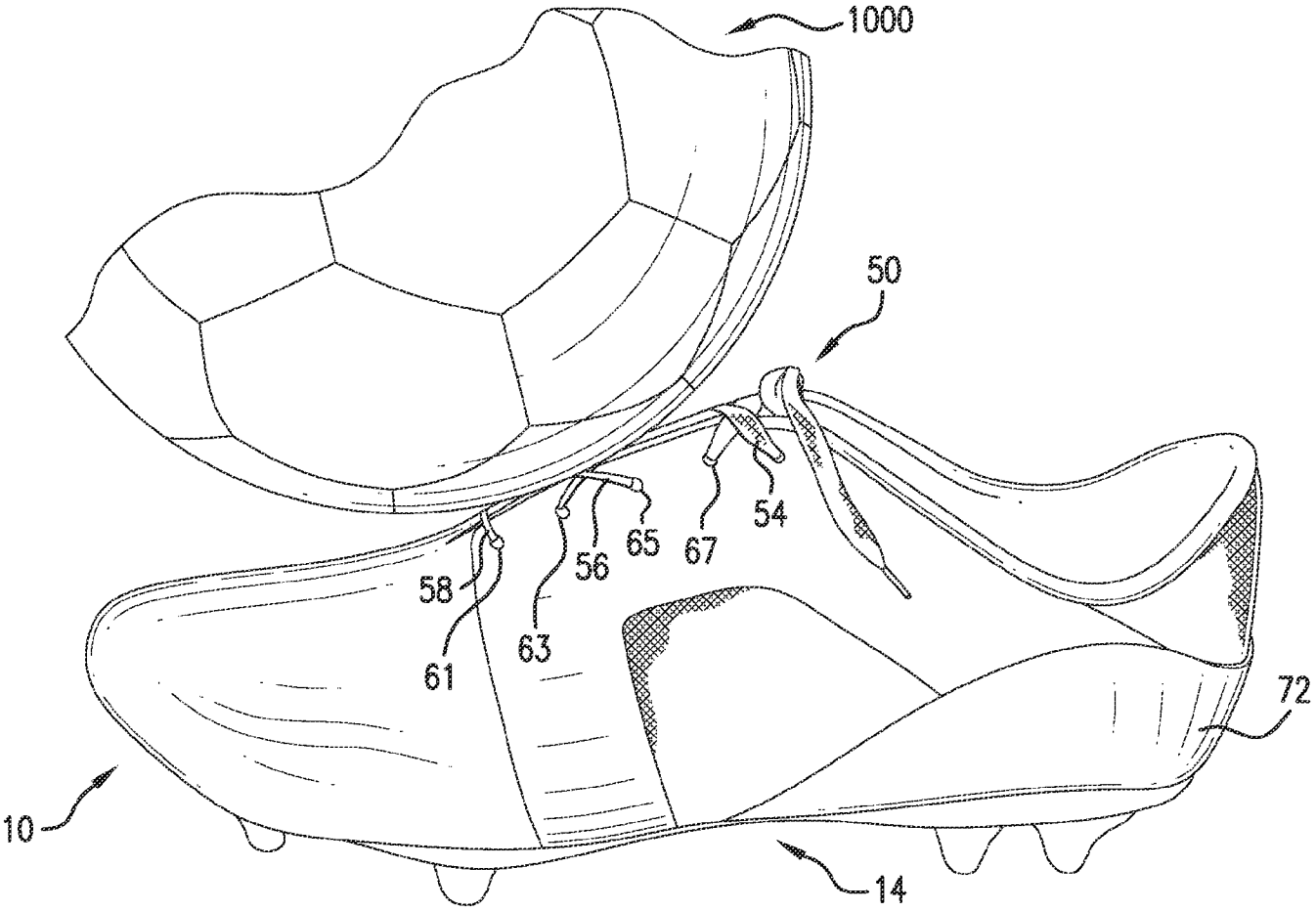
FIG. 12 shows a perspective view of an athletic shoe having a throat and lacing region in a closed configuration and being in contact with an athletic ball, consistent with an embodiment of the disclosure.

Consistent with an embodiment, in FIG. 12, footwear 10 is shown having closed throat and lacing region 32 in contact with soccer ball 1000, during a kicking action, which may be used for passing, trapping, shooting, or other finesse moves. As described earlier, footwear 10 may include provisions such as closed throat and lacing region 32 for increasing a wearer's control over a ball during various athletic activities, such as soccer. Footwear 10 may include ball control portion 1100 (shown, for example, in FIGS. 13-15) that facilitates improved shooting accuracy, passing and/or controlling the spin of a ball. One or more ball control portions can provide different types of kicking assistance. For example, ball control portion 1100 may help facilitate low trajectories for a ball, which can be useful for shooting at a goal and/or for low passes. As another example, ball control portion 1100 may help with passing a ball. In still other cases, ball control portion 1100 may help improve shooting accuracy by enhancing the ability of a player to control the spin of the ball. Consistent with an embodiment, ball control portion 1100 may be provided by closed throat and lacing region 32, as shown for example in FIG. 13-15.

Figure 13:
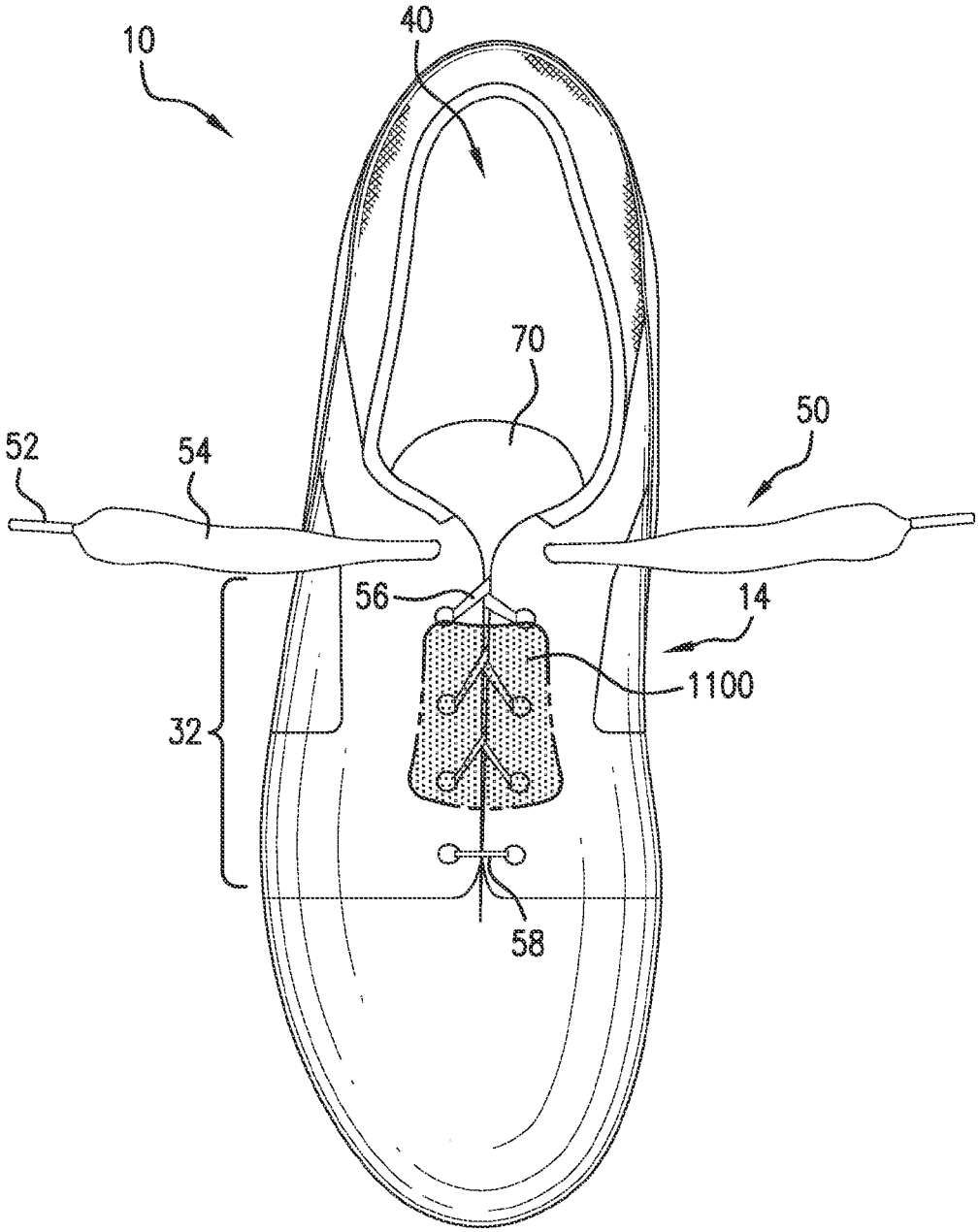
FIG. 13 shows an elevated view of a top portion of an athletic shoe having a throat and lacing region in a closed configuration, illustrating an approximate contact and control region, consistent with an embodiment of the disclosure.

Referring to FIG. 13, and consistent with an embodiment, ball contact and control portion 1100 is shown on a portion of closed throat and lacing region 32. Ball contact and control portion 1100 provides an improved surface on footwear 10 for accurate kicking and control of soccer ball 1000. Consistent with an embodiment, ball contact and control portion 1100 may be compatible with any suitable lacing configuration, including the lacing configurations described with reference to FIGS. 6-11. Consistent with an embodiment, ball control portion 1100 may be located on any portion of, or all of, throat and lacing region 32, and may be any size depending on the severity of impact or contact between soccer ball 1000 and upper 20. That is, ball control portion 1100 may cover a region of closed throat and lacing region 32 comprising one pair of lacing apertures 60, two pairs of apertures 60, three pairs of apertures 60, or more. Still reference to FIG. 13, ball control portion 1100 may form various shapes, such as squares, rectangles, circles, ovals, polygons, as well as irregular shapes.

Figure 14:
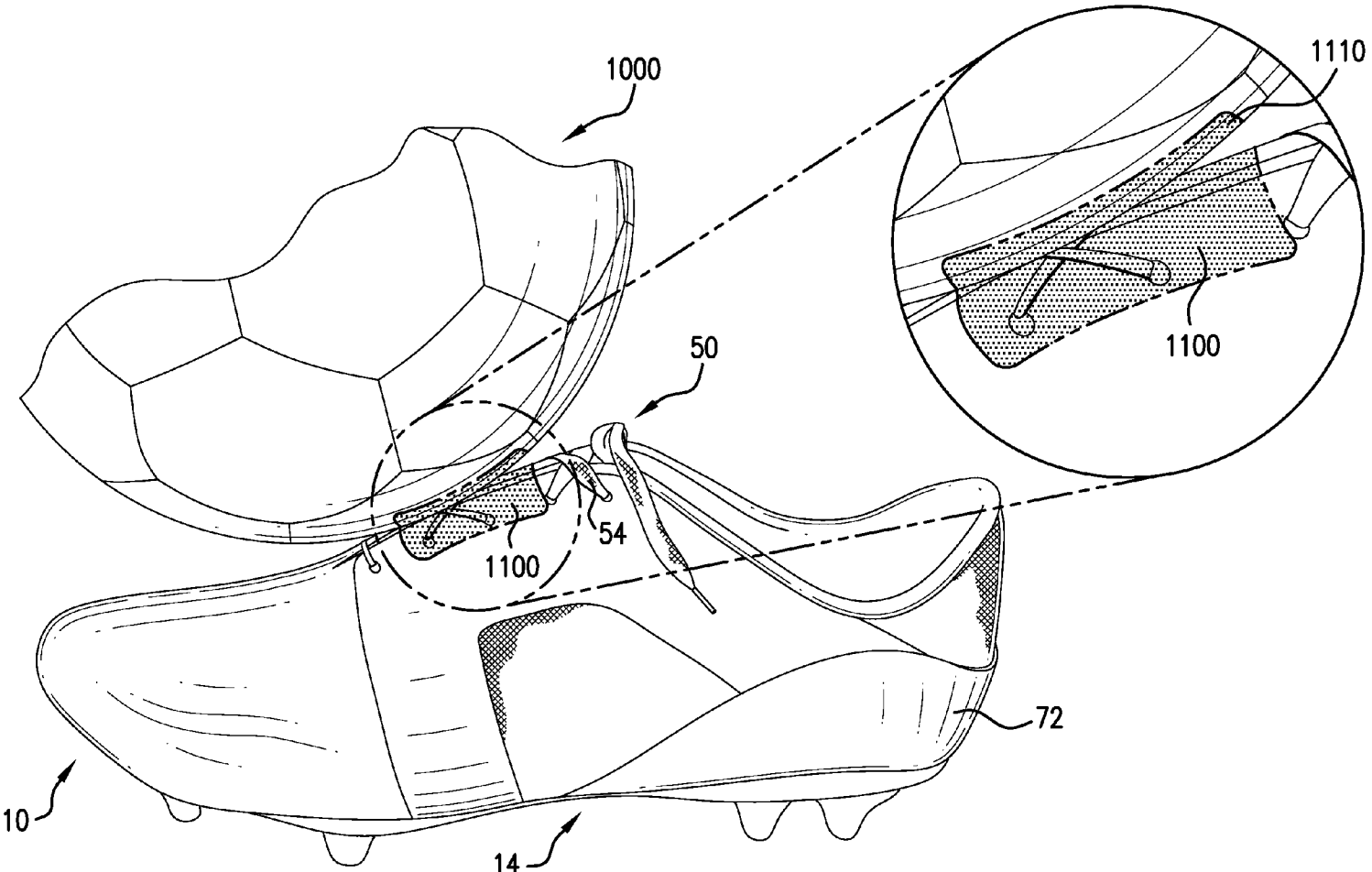
FIG. 14 shows a perspective view of an athletic shoe having a throat and lacing region in a closed configuration and illustrating an approximate contact and control region in contact with an athletic ball, consistent with an embodiment of the disclosure.

Referring to FIG. 14, and consistent with an embodiment, ball contact and control portion 1100 is shown in contact with a corresponding contact portion 1110 on soccer ball 1000. Ball contact and control portion 1100 contacts soccer ball 1000 at corresponding contact portion 1110, which may occur, for example, during a kicking or ball control action. Consistent with an embodiment, corresponding contact portion 1110 on soccer ball 1000 may be located on any portion of soccer ball 1000, and may be any size depending on the severity of impact or contact between soccer ball 1000 and upper 20. That is, corresponding contact portion 1110 on soccer ball 1000 may be a mirror image and size of ball control portion 1100 covering a region of closed throat and lacing region 32. Like ball control portion 1100, corresponding contact portion 1110 may form various shapes, such as squares, rectangles, circles, ovals, polygons, as well as irregular shapes, mirroring the shape and size of ball control portion 1100. As shown in FIG. 14, ball contact and control portion 1100 provides a substantially smooth and uninterrupted surface for contact and control of soccer ball 1000.

Figure 15:
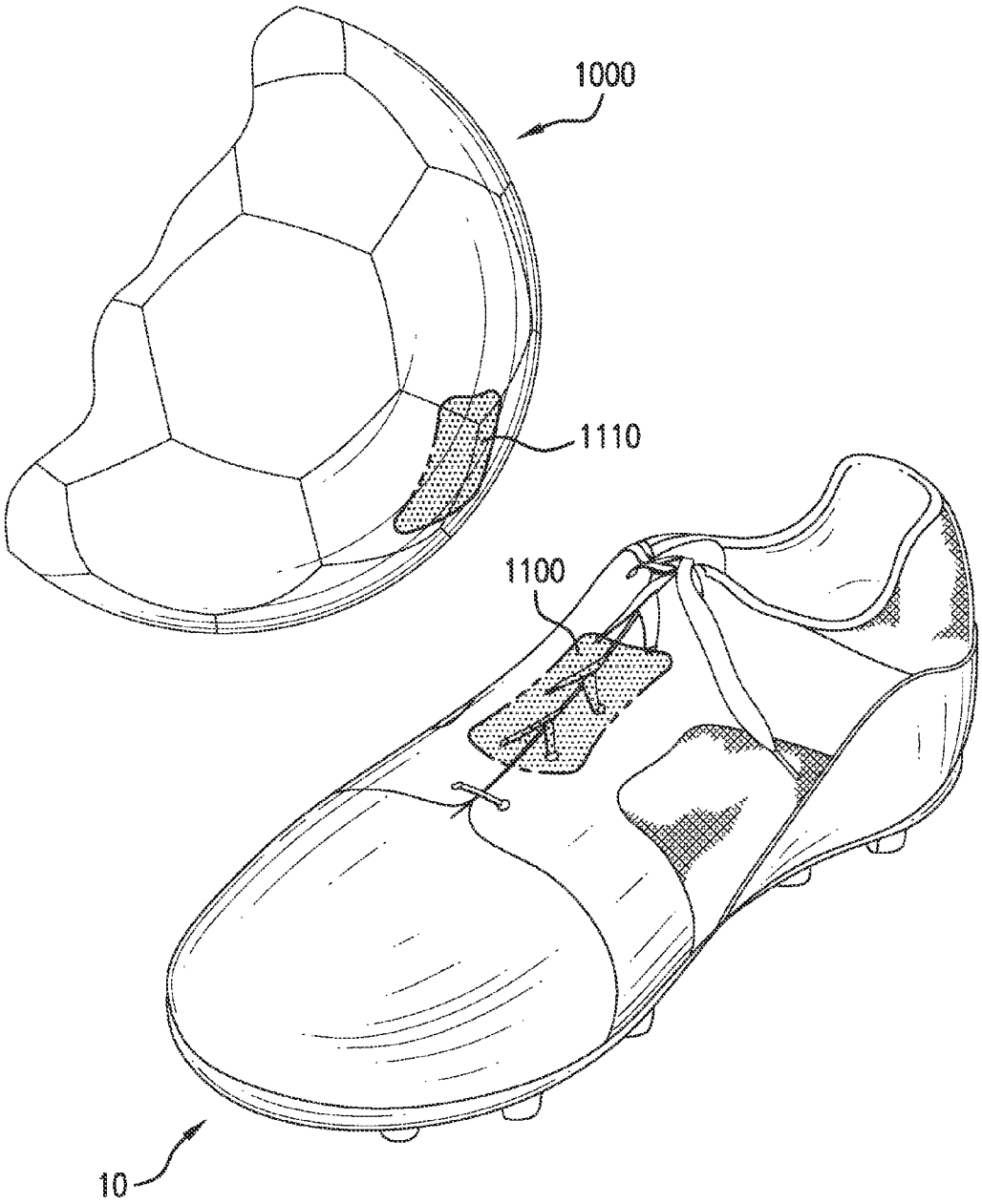
FIG. 15 shows a perspective view of an athletic shoe having a throat and lacing region in a closed configuration and illustrating an approximate contact and control region after impacting and separating from an athletic ball, consistent with an embodiment of the disclosure.

Referring to FIG. 15, and consistent with an embodiment, ball contact and control portion 1100 is shown after separation from corresponding contact portion 1110 on soccer ball 1000. As described earlier, closed throat and lacing region 32 may contact soccer ball 1000, during a kicking action, which may be used for passing, trapping, shooting, or other finesse moves. Depending on the kicking action and the surface shape and size of ball contact and control portion 1100 and corresponding contact portion 1110, separation of soccer ball 1000 from shoe may impart one or more of compression and expansion, or rotation/spin, to soccer ball 1000. Closed throat and lacing region 32 may facilitate improved control of soccer ball 1000 during these types of actions.

While various embodiments have been described, the description is intended to be exemplary, rather than limiting, and it will be apparent to those of ordinary skill in the art that many more embodiments and implementations are possible that are within the scope of the disclosure. It is intended that all such additional systems, methods, features and advantages be included within this description and this summary, be within the scope of the disclosure, and be protected by the following claims.

What is claimed is:

1. An article of footwear, comprising:

an upper having an acute angular opening in a vamp region, a base of the acute angular opening being disposed in a first region of the vamp proximate to a forefoot region of the article of footwear and an end of the acute angular opening being disposed in a second region of the vamp proximate to an ankle opening region of the article of footwear; and at least one lace having a length, comprising a first thickness in a center region of the lace length, and a second thickness at a first end region of the lace and a third thickness at a second end region of the lace, and a change in thickness of the lace between the first thickness and the second thickness and third thickness varying continuously and gradually along the length lace from the center region to the first end region and the second end region, respectively, wherein the at least one lace comprises a continuous transition in thickness from the center region to the first end region and the second end region.

2. The article according to claim 1, wherein the continuous transition in thickness is along a full length of the lace.

3. The article according to claim 1, wherein the at least one lace gets thicker from the center region towards the first end region and from the center region towards the second end region.

4. The article according to claim 1, wherein the acute angular opening in the vamp region comprises a V-shaped region.

5. The article according to claim 1, wherein the acute angular opening in the vamp region comprises approximately 1 degree to approximately 50 degrees when the at least one lace is loose.

6. The article according to claim 1, wherein the acute angular opening in the vamp region comprises approximately zero degrees to approximately 10 degrees when the at least one lace is tight.

7. The article according to claim 1, wherein the first thickness in the center region of the lace is disposed proximate to the base of the acute angular opening.

8. The article according to claim 1, wherein the second thickness and third thickness are disposed proximate to the ankle opening and extend outward from the article.

9. The article according to claim 1, wherein the first thickness in the center region of the lace is disposed proximate to the base of the acute angular opening.

10. The article according to claim 1, wherein the second thickness in each of the two end regions of the lace is disposed proximate to the ankle opening and extends outward from the article.

11. An article of footwear, comprising:

an upper having an acute angular opening in a vamp region, a base of the acute angular opening being disposed in a first region of the vamp proximate to a forefoot region of the article of footwear and an end of the acute angular opening being disposed in a second region of the vamp proximate to an ankle opening region of the article of footwear;

at least two pairs of lace apertures proximate to the acute angular opening; and at least one lace having a length, the lace comprising a first thickness in a first region of a first of the at least two pairs of lace apertures, and a second thickness in a second region of a second of the at least two pairs of lace apertures, wherein the at least one lace comprises a continuous transition in thickness from a center portion to each of two end portions, wherein the first of the at least two pairs of lace apertures is closer to the first region of the vamp proximate to the forefoot region of the article of footwear, and the second of the at least two pairs of lace apertures is closer to the second region of the vamp proximate to the forefoot region of the article of footwear.

12. The article according to claim 11, wherein the continuous transition in thickness is along a full length of the lace.

13. The article according to claim 11, wherein the at least one lace gets thicker from the center region towards the first end region and from the center region towards the second end region.

14. The article according to claim 11, wherein the acute angular opening in the vamp region comprises a V-shaped region.

15. The article according to claim 11, wherein the acute angular opening in the vamp region comprises approximately 1 degree to approximately 50 degrees when the at least one lace is loose.

16. The article according to claim 11, wherein the acute angular opening in the vamp region comprises approximately zero degrees to approximately 10 degrees when the at least one lace is tight.

* * * * *